US011839827B2

(12) United States Patent
Dyer et al.

(10) Patent No.: US 11,839,827 B2
(45) Date of Patent: Dec. 12, 2023

(54) INTERACTIVE TOY

(71) Applicant: Storytime Toys Inc., Concord, MA (US)

(72) Inventors: Kara Meredith Dyer, Concord, MA (US); Sara Ellen Peiffer, Portsmouth, NH (US); Michael Eisenstein, Toronto (CA)

(73) Assignee: Storytime Toys Inc., Concord, MA (US)

( * ) Notice: Subject to any disclaimer, the term of this patent is extended or adjusted under 35 U.S.C. 154(b) by 0 days.

(21) Appl. No.: 17/718,541

(22) Filed: Apr. 12, 2022

(65) Prior Publication Data

US 2022/0339531 A1 Oct. 27, 2022

Related U.S. Application Data

(60) Provisional application No. 63/178,717, filed on Apr. 23, 2021.

(51) Int. Cl.
*A63F 9/10* (2006.01)

(52) U.S. Cl.
CPC ..... *A63F 9/10* (2013.01)

(58) Field of Classification Search
CPC .. A63F 9/10; A63F 9/1044; A63F 2009/1022; A63F 9/12; A63F 2009/1005
See application file for complete search history.

(56) References Cited

U.S. PATENT DOCUMENTS 1,229,580 A * 6/1917 Brown ..... A63F 9/12 273/157 R
1,477,322 A * 12/1923 O'Toole ..... G09B 1/34 273/157 R
1,972,206 A * 9/1934 Thomay ..... A63F 9/10 273/157 R (Continued)

FOREIGN PATENT DOCUMENTS

CN 109126114 A * 1/2019
DE 202010011043 U1 * 12/2010 ..... A47G 29/08

(Continued)

OTHER PUBLICATIONS

"How Do You Pick a Foam?", <https://tntcosplaysupply.com/how-do-you-pick-a-foam/>, retrieved on Nov. 3, 2022. (Year: 2020).*

*Primary Examiner* — Steven B Wong
(74) *Attorney, Agent, or Firm* — Occhiuti & Rohlicek LLP

(57) ABSTRACT

A toy having a theme comprises a puzzle including first pieces, second pieces and a frame support. The first pieces are configured to be assembled into a three-dimensional structure. Each of the first pieces includes at least one of a tab and a hole. In particular, the hole is sized and shaped to receive the tab of another one of the pieces. Each of the second pieces are configured to interactively cooperate with the three-dimensional set piece. Each of the first and second pieces also includes a graphic image associated with the theme of the toy. The frame support is substantially flat with a first side having recesses for receiving each of the first and second pieces. The frame support also has a second side, opposite the first side having a graphic image (e.g., representative of a stage) associated with the theme of the toy.

12 Claims, 3 Drawing Sheets

(56) References Cited

U.S. PATENT DOCUMENTS 2,731,766 A * 1/1956 Rubin ..... A63F 9/12 446/99
3,422,563 A * 1/1969 Kiley ..... A63F 9/10 273/157 R
3,701,214 A * 10/1972 Sakamoto ..... A63H 33/082 446/116
4,235,039 A * 11/1980 Brooks ..... A63H 3/52 446/482
4,298,200 A * 11/1981 Kanbar ..... A63F 9/0669 434/347
4,570,936 A * 2/1986 Meiser ..... A63F 9/12 273/157 R
4,824,112 A * 4/1989 Roy ..... A63F 9/1288 273/157 R
4,846,750 A * 7/1989 Tapdrup ..... A63F 9/12 446/128
5,212,842 A * 5/1993 Glydon ..... A63H 33/082 428/44
5,251,900 A * 10/1993 Gallant ..... A63H 33/042 273/157 R
5,306,006 A * 4/1994 Bell ..... A63F 9/0098 273/156
5,443,263 A * 8/1995 Olmsted ..... G09B 1/40 273/157 R
5,615,883 A * 4/1997 Stevens ..... A63F 9/12 273/157 R
5,791,647 A * 8/1998 Reiling ..... A63F 9/10 273/157 R
6,086,067 A * 7/2000 Benoit ..... A63H 33/044 446/109
6,120,344 A * 9/2000 Brown ..... A63H 3/16 446/376
6,234,858 B1 * 5/2001 Nix ..... A63H 3/08 446/385
6,575,803 B1 * 6/2003 Liu ..... A63H 3/08 446/85
6,626,732 B1 * 9/2003 Chung ..... A63H 3/52 446/268
8,210,892 B2 * 7/2012 Thrush ..... A63F 9/1288 446/120
9,227,145 B2 * 1/2016 Chang ..... A63H 3/10
2005/0200076 A1 * 9/2005 Wu ..... A63F 9/10 273/157 R
2021/0060410 A1 * 3/2021 Sakdinan ..... A63F 9/10

FOREIGN PATENT DOCUMENTS

EP 2070568 A1 * 6/2009 ..... A61F 9/10
EP 2177249 A1 * 4/2010 ..... A63F 9/1044
GB 2263645 A * 8/1993 ..... A63F 9/12
GB 2296188 A * 6/1996 ..... A47G 27/025
JP H11207771 A * 8/1999
KR 20130006644 U * 11/2013
WO WO-2013091646 A1 * 6/2013 ..... A63F 9/0666

* cited by examiner

INTERACTIVE TOY

CROSS REFERENCE TO RELATED APPLICATIONS

This application claims priority to U.S. Application No. 63/178,717, filed on Apr. 23, 2021, the contents of which is hereby incorporated by reference in its entirety.

BACKGROUND

This invention relates to an interactive toy for toddlers and preschoolers.

Wooden knob puzzles are popular toys for toddlers and preschoolers. They are thick, wooden puzzles with pieces that are removed with a knob. The pieces have open areas with graphics that match graphics on a corresponding piece that the child can use as a cue to return it to its place. These puzzles encourage hand-eye coordination and visual perception skills.

There are also three-dimensional (3D) jigsaw puzzles, which are typically made for adults with hundreds of pieces that make them complicated and time-consuming to assemble. Pieces are connected using either a dovetail or box joint at the corners and a jigsaw puzzle type locking system for the flat areas. Such 3D puzzles are often made from thin wood which often requires more complicated mechanisms for assembly. However, such 3D puzzles are generally not made for young children because of their high number of pieces and complex assembly.

SUMMARY

In a general aspect, a toy having a theme comprises a puzzle including first pieces, second pieces and a frame support. The first pieces are configured to be assembled into a three-dimensional structure. Each of the first pieces includes at a tab or a hole. In particular, the hole is sized and shaped to receive the tab of another one of the pieces. Each of the second pieces are configured to interactively cooperate with the three-dimensional set piece. Each of the first and second pieces also includes a graphic image associated with the theme of the toy. The frame support is substantially flat with a first side having recesses for receiving each of the first and second pieces. The frame support also has a second side, opposite the first side having a graphic image associated with the theme of the toy.

Embodiments of this aspect of the invention may include one or more of the following features.

Each of the recesses on the first side of the frame support being sized and shaped commensurately with the size and shape of the first pieces and the second pieces. The first side of the frame support side having a graphic image associated with the theme of the toy. The graphic images of the plurality of first pieces for forming the three-dimensional structure are representative of a set piece. The graphic images of the plurality of second pieces are representative of characters. The graphic image on the second side of the frame support is representative of a stage. The stage is representative of the environment of the theme of the toy.

The first pieces, the second pieces, and the frame support are each formed of a laminate including: a substantially rigid substrate; and a layer of high-density foam overlying the substrate. The substantially rigid substrate is formed of cardboard. The high-density foam is formed of ethylene-vinyl acetate (EVA).

Other features and advantages of the invention are apparent from the following description, and from the claims.

DESCRIPTION

Figure 1:
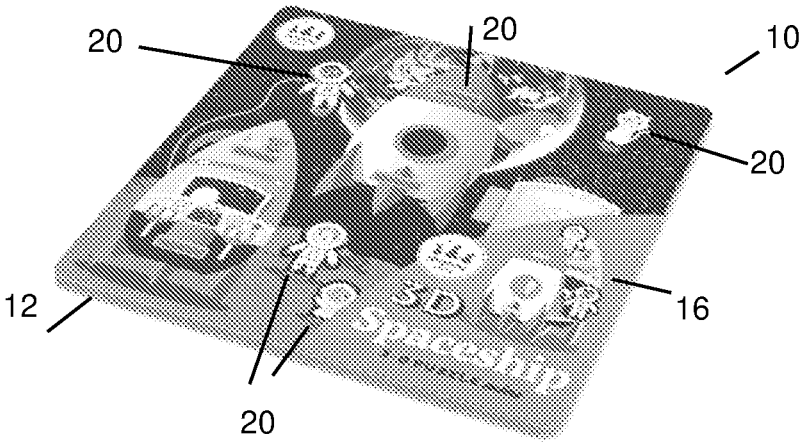
FIG. 1 is an isometric view of the interactive toy in its packaged state.

Referring to FIG. 1, a toy 10 as would be available to a consumer and shown as packaged with a promotional card 16, which describes the toy. In this state, toy 10 includes a frame support 12 holding multiple pieces 20. In this particular embodiment, the toy 10 is spaceship themed.

Figure 2:
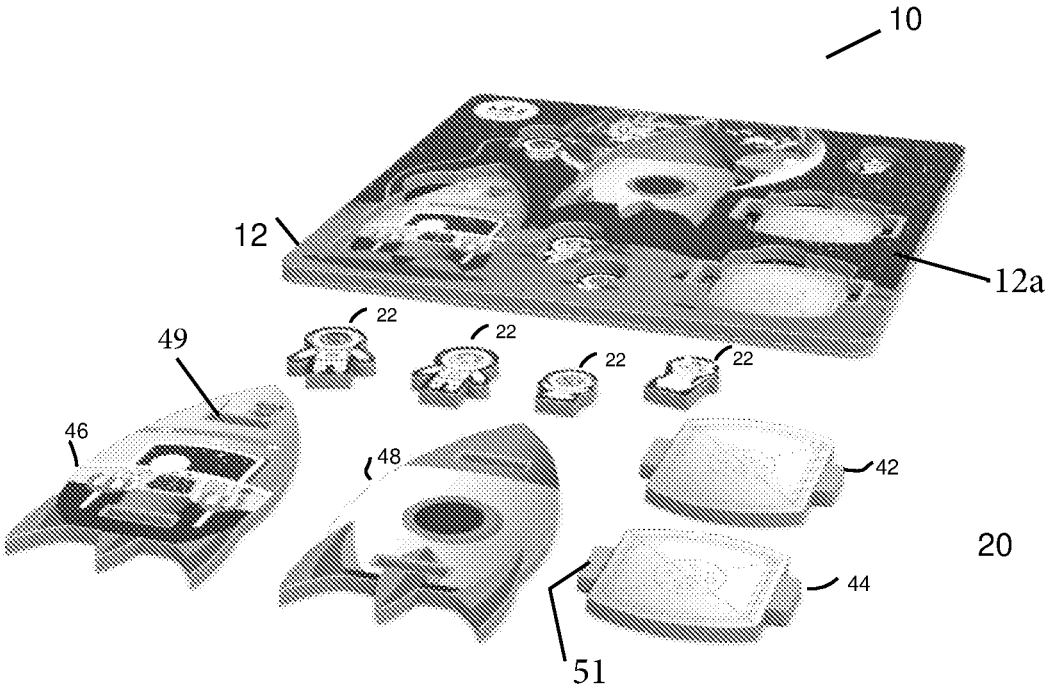
FIG. 2 is an isometric view of the interactive toy of FIG. 1 with pieces of the toy removed from its support frame.
Figure 3:
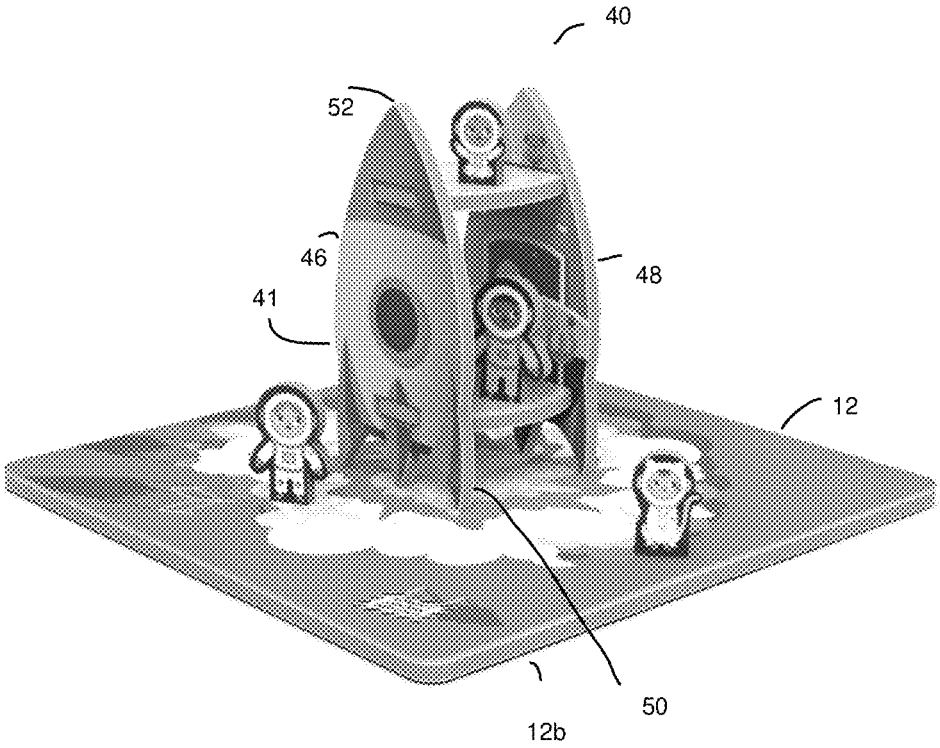
FIG. 3 is an isometric view of the interactive toy of FIG. 1 in its assembled state.

Referring to FIG. 2, the pieces 20 include individual character dolls 22, as well as a three-dimensional puzzle, which when assembled forms an assembled spaceship 40 (see FIG. 3). The spaceship 40 includes outer side sections 46, 48 that form a fuselage of the spaceship 40 as well as internal floor sections 42, 44 positioned between the outer side sections.

Frame support 12 of toy 10 serves as both a playing surface for the assembled spaceship 40 and character dolls 22, while also serving as a self-contained storage for the character dolls 22 and the disassembled pieces of the spaceship 40 (i.e., outer side sections 46, 48 and internal floor sections 42, 44). Frame support 12, whose construction is described in greater detail below, includes a laminate base having graphics/artwork on its front side and back side. The top surface 12*a* of the frame support illustrates artwork/images matching the individual pieces 20 that in combination with the shape of the openings on the top surface 12*a*, give a consumer, particularly a child, an indication as to where each of the pieces fit in the top surface 12*a* of the frame support 12.

As shown in FIG. 3, bottom surface 12*b* of the frame support 12 serves as the playing surface illustrating a rocket launch pad in bright and playful colors. In its assembled state, spaceship 40 includes outer side sections 46, 48, which extend from fins 50 at a bottom end to a nose cone 52 at the top end of the fuselage 41 of the spaceship 40. The outer side sections 46, 48 include holes 49 near the top end and bottom end of each side. The internal floor sections include tabs 51 on left and right side of the section. The holes 49 of outer side sections 46 and 48 and the tabs 51 of internal floor sections 42 and 44 are made from a composite of high-density EVA foam. The holes 49 of the outer side sections are slightly undersized so that a corresponding tab 51 from the internal floor sections is compressed while being pressed into the hole, and it can expand once it is in place to form a tight fit.

Figure 4:
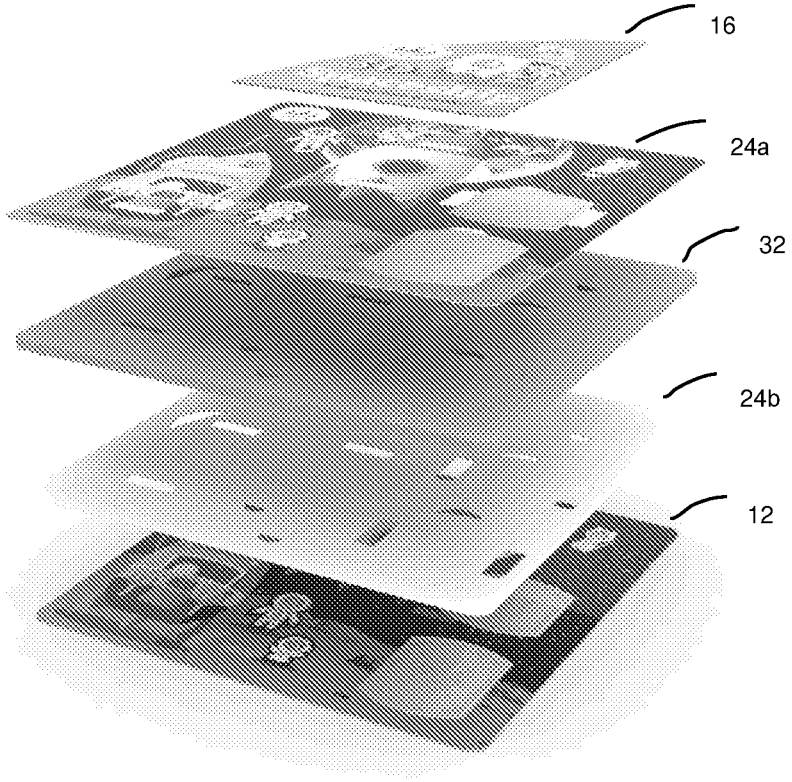
FIG. 4 is an exploded view of the interactive toy of FIG. 1 showing the various layers used in the construction of the pieces of the toy.

Referring to FIG. 4, the toy 10 includes a foam layer 32 having sufficient thickness (e.g., 4-10 mm) to provide sufficient rigidity and stability to be handled by a toddler as a toy piece. As will be described below, the foam layer is also sufficiently resilient to allow the pieces to be connected to each other.

To provide additional rigidity to the pieces, a front-facing layer 24*a* and a rear-facing layer 24*b*, are each formed of cardstock with a thickness in a range, for example, of .25 mm to .5 mm. Front-facing layer 24*a* and rear-facing layer 24*b* are adhesively backed for attachment to opposite sides of foam layer 32. Each of front-facing layer 24*a* and rear-facing layer 24*b* have graphics consistent with the individual toy pieces. For example, the front-facing layer 24*a* and rear-facing layer 24*b* of character dolls 22 include graphics for different astronaut characters. Similarly, front-facing layer 24*a* and rear-facing layer 24*b* of the outer side sections 46, 48 and internal floor sections 42, 44 include graphics depicting parts of the body of spaceship 40. In this embodiment, the graphics used for the front-facing layer 24*a* and rear-facing layer 24*b* pieces are different. For example, outer side sections 46, 48 include a side having graphics depicting the outside of the spaceship fuselage while the opposite includes graphics depicting the inside of the spaceship. In other embodiments, the graphics on each side may be mirror images of each other.

Referring again to FIG. 2, it is important to note that tabs 51 of the pieces do not include the cardstock material of the front-facing layer 24*a* and a rear-facing layer 24*b*. Similarly, margined areas surrounding holes 49 of outer side sections 46, 48 do not include the cardstock material of the front-facing layer 24*a* and a rear-facing layer 24*b*. Eliminating the cardstock materials in these areas permits tabs 51 to more easily be received in holes 49. Moreover, once tabs 51 are received in holes 49, the lack of cardstock materials in these areas allows the resilient foam material of the attached pieces to be interlocked.

Although FIGS. 1-4 are spaceship themed, it is important to note that an endless number of themes can be used for the toy and the pieces can represent any number of animate and inanimate characters.

It is to be understood that the foregoing description is intended to illustrate and not to limit the scope of the invention, which is defined by the scope of the appended claims. Other embodiments are within the scope of the following claims.

What is claimed is:

1. A toy having a theme, the toy comprising: a puzzle including a plurality of first pieces, a plurality of second pieces, and a frame support, wherein the first pieces, the second pieces, and the frame support are each formed of a laminate that comprises a substantially rigid substrate and a layer of ethylene vinyl acetate (EVA), the layer of EVA having a first surface that overlies a surface of the substrate, each of the first pieces having a tab or a hole, the hole of a first one of the first pieces sized and shaped to receive the tab of a second one of the first pieces, wherein the tabs and holes comprise EVA that is exposed such that the tab is compressed while being pressed into the hole and expands once in place in the hole, wherein the EVA of the tab is in direct contact with the EVA of the hole, thus resulting in a tight fit between the hole and the tab, wherein the tabs lack the substantially rigid substrate, and wherein margined areas surrounding the holes lack the substantially rigid substrate, thereby allowing the EVA of attached pieces to be interlocked, each of the first pieces including a graphic image associated with the theme of the toy, the first pieces of the puzzle, when assembled, forming a three-dimensional set piece;

each of the second pieces being configured to interactively cooperate with the three-dimensional set piece, each of the second pieces including a graphic image associated with the theme of the toy; and the frame support being substantially flat and including:

a first side having a plurality of recesses, each of which receives one of the first pieces or one of the second pieces, whereby the EVA from the frame support engages the EVA from each of the first and second pieces that have been received in the recesses; and a second side opposite the first side, the second side having a first graphic image associated with the theme of the toy.

2. The toy as claimed in claim 1, wherein each of the recesses on the first side of the frame support is sized and shaped commensurately with the size and shape of corresponding ones of the first pieces and the second pieces and wherein the first side is a storage side.

3. The toy as claimed in claim 1, wherein the first side of the frame support, which is a storage side, comprises a second graphic image associated with the theme of the toy.

4. The toy as claimed in claim 1, wherein the graphic images of the plurality of first pieces for forming the three-dimensional structure is representative of the set piece.

5. The toy as claimed in claim 1, wherein the graphic images of the plurality of second pieces are representative of characters.

6. The toy as claimed in claim 1, wherein the first graphic image on the second side of the frame support, which is a playing side, is representative of a stage.

7. The toy as claimed in claim 6, wherein the stage is representative of the environment of the theme of the toy.

8. The toy as claimed in claim 1, wherein the substantially rigid substrate is formed of cardboard.

9. The toy as claimed in claim 1, further comprising a second substantially rigid substrate overlying a second surface of the layer of ethylene vinyl acetate.

10. The toy of claim 1, wherein the toy is configured to transition between a first state, in which the first and second pieces are disposed to be in said recesses in the first side, the first side being a storage side, and a second state, in which the first and second pieces are disposed on the second side the second side being a playing side.

11. The toy as claimed in claim 1, wherein the first side of the frame support side, which is a storage side, comprises a portion of a second graphic image associated with the theme of the toy and wherein, when placing said first and second pieces in said recesses completes said second graphic image.

12. The toy as claimed in claim 1, wherein, the frame support is disposed such that, when the toy is in use, the first side rests on a surface, thereby concealing the recesses that receive the first and second pieces, wherein, when the toy is not in use, the first and second pieces are stored in the recesses of the first side, thereby completing a second graphic image that is both associated with the theme of the toy and visible for display while the toy is not in use, wherein, when the toy is in use, the first and second pieces are disposed on the second side of the frame support, thereby causing the second graphic image on the first side to become incomplete, whereby removal of the first and second pieces from the recesses causes the second graphic image to become incomplete and no longer visible for display, whereby the second graphic image remains incomplete until the first and second pieces have been returned to their respective recesses.

* * * * *